United States Patent [19]

Erbstoesser

[11] 4,244,425

[45] * Jan. 13, 1981

[54] LOW DENSITY BALL SEALERS FOR USE IN WELL TREATMENT FLUID DIVERSIONS

[75] Inventor: Steven R. Erbstoesser, Missouri City, Tex.

[73] Assignee: Exxon Production Research Company, Houston, Tex.

[ * ] Notice: The portion of the term of this patent subsequent to Jul. 25, 1995, has been disclaimed.

[21] Appl. No.: 35,564

[22] Filed: May 3, 1979

[51] Int. Cl.[3] ..... E21B 33/13; E21B 43/26; E21B 43/27

[52] U.S. Cl. ..... 166/284; 166/193; 166/281

[58] Field of Search ..... 166/284, 192, 193, 194, 166/153, 179, 285, 292, 295; 273/58 R, 58 A, 230

[56] References Cited

U.S. PATENT DOCUMENTS

| | | | |
|---|---|---|---|
| 2,754,910 | 7/1956 | Derrick et al. | 166/284 |
| 3,010,514 | 11/1961 | Fox | 166/284 |
| 3,376,934 | 4/1968 | Willman et al. | 166/284 X |
| 3,437,147 | 4/1969 | Davies | 166/284 |
| 4,102,401 | 7/1978 | Erbstoesser | 166/284 |
| 4,139,060 | 2/1979 | Muecke et al. | 166/284 X |
| 4,160,482 | 7/1979 | Erbstoesser et al. | 166/284 |

*Primary Examiner*—Stephen J. Novosad
*Attorney, Agent, or Firm*—Robert B. Martin

[57] ABSTRACT

A ball sealer for use as a diverting agent when treating a well having a perforated casing. The ball sealer is sized to plug a perforation and has a density less than the treating fluid. The ball sealer comprises a material, such as syntactic foam or polymethylpentene. The ball sealer is also preferably provided with a protective covering material. After some of the treating fluid has been injected into the well, the ball sealers are injected and carried by the fluid flow down to the perforations where they seat and divert the further injection of treating fluid through the remaining open perforations.

21 Claims, 5 Drawing Figures

LOW DENSITY BALL SEALERS FOR USE IN WELL TREATMENT FLUID DIVERSIONS

BACKGROUND OF THE INVENTION

1. Field of the Invention.

This invention pertains to the treating of wells and more particularly to an improved perforation plugging element and the utilization of such elements for temporary closing of such perforations in the casing.

2. Description of the Prior Art.

It is common practice in completing oil and gas wells to set a string of pipe, known as casing, in the well and use cement around the outside of the casing to isolate the various formations penetrated by the well. To establish fluid communication between the hydrocarbon bearing formations and the interior of the casing, the casing and cement sheath are perforated.

At various times during the life of the well, it may be desirable to increase the production rate of hydrocarbons through treatment such as acidizing or hydraulic fracturing. If only a short, single pay zone in the well has been perforated, the treating fluid will flow into the pay zone where it is required. As the length of the perforated pay zone or the number of perforated pay zones increases, the placement of the fluid treatment in the regions of the pay zones where it is required becomes more difficult. For instance, the strata having the highest permeability will most likely consume the major portion of a given stimulation treatment leaving the least permeable strata virtually untreated. Therefore, techniques have been developed to divert the treating fluid from its path of least resistance so that the low permeability zones are also treated.

One technique for achieving diversion involves the use of downhole equipment such as packers. Although these devices are effective, they are quite expensive due to the involvement of associated workover equipment required during the tubing-packer manipulations. Additionally, mechanical reliability tends to decrease as the depth of the well increases.

As a result, considerable effort has been devoted to the development of alternative diverting methods. One of the most popular and widely used diverting techniques over the past 20 years has been the use of small rubber-coated balls, known as ball sealers, to seal off the perforations inside the casing.

These ball sealers are pumped into the wellbore along with the formation treating fluid. The balls are carried down the wellbore and on to the perforations by the flow of the fluid through the perforations into the formation. The balls seat upon the perforations and are held there by the pressure differential across the perforation.

The major advantages of utilizing ball sealers as a diverting agent are: easy to use, positive shutoff, independent of the formation, and non-damaging to the well. The ball sealers are simply injected at the surface and transported by the treating fluid. Other than a ball injector, no special or additional treating equipment is required. The ball sealers are designed to have a solid core which resists extrusion into or through the perforation. Therefore, the ball sealers will not penetrate the formation and permanently damage the flow characteristics of the well.

Several requirements are repeatedly applied to ball sealers as they are normally utilized today. First, the ball sealers must be chemically inert in the environment to which they are exposed. Second, they must seal effectively, yet not extrude into the perforations. Third, the ball sealer must release from the perforations when the pressure differential into the formation is relieved. Fourth, the ball sealers are generally heavier than the wellbore fluid so that they will sink to the bottom of the well, and out of the way, upon completion of the treatment.

Although present-day ball sealer diverting techniques have met with considerable usage, there is abundant evidence which indicates that the ball sealers often do not perform effectively because only a fraction of the ball sealers injected actually seat on perforations. The present-day practice of using ball sealers having a density greater than the treating fluid yields a low and unpredictable seating efficiency highly dependent on the difference in density between the ball sealers and the fluid, the flow rate of the fluid through the perforations, and the number, spacing and orientation of the perforations. The net result is that the plugging of the desired number of perforations at the proper time during the treatment to effect the desired diversion is left completely to chance.

When these inefficiencies lead to treatment failures, it is generally believed that these failures result from insufficient flow being carried through the perforations, thereby allowing the balls to fall to the bottom of the well without achieving fluid diversion. Attempts to overcome this problem generally include pumping a quantity of balls which exceeds the number of perforations. Although this procedure can be helpful, it has not proven to be a satisfactory solution.

SUMMARY OF THE INVENTION

The method of the present invention overcomes the limitations of present-day ball sealer diversion methods. The present invention utilizes ball sealers having a density less than the treating fluid. These ball sealers exhibit substantially 100% seating efficiency in laboratory tests.

The method of the present invention involves flowing a treating fluid downward in the casing, through the perforations and into the formation surrounding the perforated parts of the casing. At the appropriate time during the treatment, plugging members, i.e., ball sealers, are introduced into the treating fluid at the surface. These ball sealers will have a size sufficient to plug the casing perforations and a density less than the density of the treating fluid within the casing. Thereafter, the downward flow of the fluid within the casing will be continued at a rate such that the downward velocity of the fluid in the casing above the perforations is sufficient to impart a downward drag force on the ball sealers greater in magnitude than the upward buoyancy force acting on the ball sealers to thereby transport the ball sealers to the perforations. Once the ball sealers have reached the perforations, they will seat on perforations taking fluid, plug the perforations and cause the treating fluid to be diverted to the remaining open perforations.

The ball sealers themselves must comprise a low density high strength material capable of withstanding the pressures existing within the well. The pressures acting on the ball sealers in the well are the hydrostatic pressure of the fluid in the wellbore and the pumping pressure. The material cannot collapse under the pressures in the well because the decrease in volume of the ball sealer upon collapse will result in a corresponding increase in the density of the ball sealer which can then easily exceed the density of the treating fluid. It has been found that materials that meet the density and compressive strength requirement include syntactic foam and polymethylpentene. Thus, ball sealers comprising syntatic foam or polymethylpentene exhibit both a low density and a high compressive strength. The ball sealers of the present invention are preferably provided with a protective covering. The protective covering may comprise a nonelastomeric plastic material capable of plastic deformation. However, it will be obvious to one skilled in the art that other types of nonplastic protective covering materials such as aluminum may also be utilized in the practice of the present invention.

After the treatment of the hydrocarbon-bearing strata has been completed, the pressure on the fluid in the casing will be relieved causing the ball sealers to be released from the perforations where they were seated. The ball sealers will rise within the casing due to their buoyancy and to the upward flow of fluids from the well to the earth's surface. A ball catcher may be provided to trap all of the ball sealers upstream of any equipment which they might clog or damage.

The method of the present invention provides certainty in diversion heretofore unknown in well treatment operations.

DESCRIPTION OF THE PREFERRED EMBODIMENTS

Figure 1:
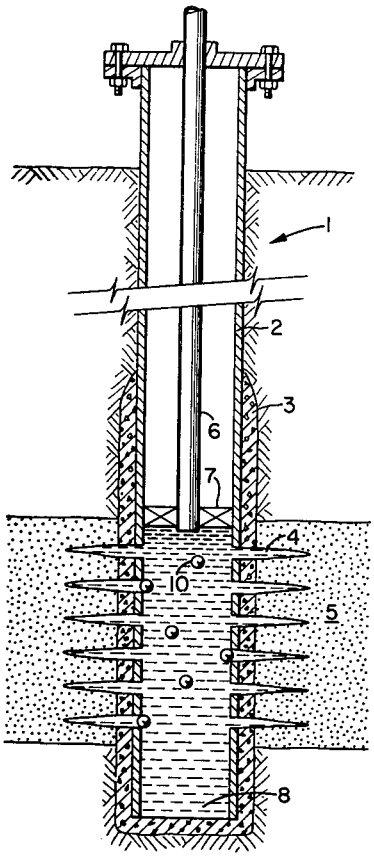
FIG. 1 is an elevation view in section of a well illustrating the practice of the present invention.

Utilization of the present invention according to the preferred embodiment is depicted in FIG. 1. The well 1 of FIG. 1 has a casing 2 run to the bottom of the wellbore and cemented around the outside to hold casing 2 in place and isolate the penetrated formations or intervals. The cement sheath 3 extends upward from the bottom of the wellbore at least to a point above the producing strata 5. For the hydrocarbons in the producing strata 5 to be produced, it is necessary to establish fluid communication between the producing strata 5 and the interior of the casing 2. This is accomplished by perforations 4 made through the casing 2 and the cement sheath 3.

The hydrocarbons flowing out of the producing strata 5 through the perforations 4 and into the interior of the casing 2 are transported to the surface through a production tubing 6. A production packer 7 is installed near the lower end of the production tubing 6 and above the highest perforation to achieve a pressure seal between the production tubing 6 and the casing 2. Production tubings are not always used and, in those cases, the entire interior volume of the casing is used to conduct the hydrocarbons to the surface of the earth.

When diversion is needed during a well treatment, ball sealers are often used to close off some of the perforations. These ball sealers are preferred to be approximately spherical in shape, but other geometries may also be utilized.

To use the ball sealers 10 to plug some of the perforations 4, the first step is to introduce the ball sealers 10 into the casing 2 at a predetermined time during the treatment. The ball sealers can be introduced into the fluid either before or after the fluid is pumped into the upper end of the casing. Methods of accomplishing these procedures are well known in the art.

When the ball sealers 10 are introduced into the fluid upstream of the perforated parts of the casing, they are carried down the production tubing 6 or casing 2 by the fluid flow. Once the fluid arrives at the perforated parts of the casing, it moves radially outward, in addition to its downward movement, toward and through the perforations 4. The flow of the treating fluid through the perforations 4 carries the ball sealers 10 over to the perforations 4 and seats them on the perforations 4. The ball sealers 10 are held there by the fluid pressure differential, thereby effectively closing those perforations 4 until such time as the pressure differential is relieved or reversed. Ideally, the ball sealers 10 will first seal the perforations through which the treating fluid is flowing most rapidly. This preferential closing of the perforations promotes distribution of the treatment over the entire distance of the perforations.

The prior art teaches that it is preferred for the density of the ball sealers to be equal to or greater than the density of the treating fluid. It is worth examining the prior art ball sealer seating mechanism to be able to contrast it to the present invention. The velocity of ball sealers more dense than the fluid in the wellbore is comprised of two components. Each ball sealer has a settling velocity always directed vertically downward due to the difference in the densities of the ball sealer and the fluid. The second component of the ball sealer's velocity is attributable to the drag forces imposed upon the ball sealer by the moving fluid shearing around the ball sealer. This velocity component will be in the direction of the fluid flow. Within the production tubing or within the casing above the perforations, the velocity component due to the fluids will be generally downward.

Just above the perforated part of the casing the fluid takes on a horizontal velocity component directed radially outward toward and through the perforations 4. The flow through any perforation must be sufficient to draw the ball sealer 10 to the perforation before the ball sealer sinks past that perforation. If the flow of the treating fluid through the various perforations does not draw the ball sealer to a perforation by the time the ball sealer sinks past the lowest perforation, the ball sealer will simply sink into the rathole 8 where it will remain.

In contrast, the present invention contemplates the use of ball sealers 10 having a density less than the density of the treating fluid. Within the wellbore, each ball sealer has a velocity comprised of two opposing components. The first velocity component is directed vertically upward due to the buoyancy of the ball sealer in the fluid. The second velocity component is attributable to the drag forces imposed upon the ball sealer by the motion of the fluid shearing past the ball sealer. Above the perforations, this second velocity component will be directed generally downward. It is essential that the downward fluid velocity in the production tubing 6 and in the casing 2 above the perforations 4 be sufficient to impart a downward drag force on the ball sealers which is greater in magnitude than the upward force of buoyancy acting on the ball sealers. This results in the ball sealers being carried downward to the section of the casing which has been perforated.

When ball sealers are utilized in accordance with the present invention, they will never remain in the rathole 8; that is, below the lowest perforation through which the treating fluid is flowing, due to the buoyancy of the ball sealers. Below the lowest perforation accepting the treating fluid, the fluid in the wellbore remains stagnant and there are no downwardly directed drag forces acting on the ball sealers to keep them below the lowest perforation taking the treating fluid. Hence, the upward buoyancy forces acting on the ball sealers will dominate in this interval.

Therefore, the practice of the present invention results in the vertical velocity of each ball sealer being a function of its vertical position within the casing. At least below the lowest perforation, and possibly higher if little fluid is flowing down to and through the lower perforations, the net vertical velocity of each ball sealer will be upward due to the dominance of the buoyancy force over any downward fluid drag force. At least above the highest perforation, and possibly lower if little fluid is flowing through those higher perforations, the net vertical velocity of each ball sealer will be downward due to the dominance of the downward fluid drag force over the buoyancy force.

The ball sealers having a density less than the density of the treating fluid will remain within, or moving toward, that portion of the casing between the uppermost perforation and the lowermost perforation through which fluid is flowing until the ball sealers seat upon a perforation. While suspended within that portion of the casing, the motion of the fluid radially outward into and through the perforations will exert drag forces on the ball sealers to move them radially outward to the perforations where they will seat and be held there by the pressure differential.

The net result of the use of the present invention is that the ball sealers injected into the well and transported to the perforated zone of the casing will generally experience substantially 100% seating efficiency as demonstrated in laboratory tests.

When the treatment has been completed and the pressure differential relieved or reversed, the ball sealers will unseat from the perforations. With ball sealers having a density less than the wellbore fluid, the ball sealers will naturally migrate upward. Therefore, some means should be provided to catch these ball sealers before they pass into equipment which might clog or damage. A ball catcher 30 which will accomplish this is depicted in FIG. 2.

Figure 2:
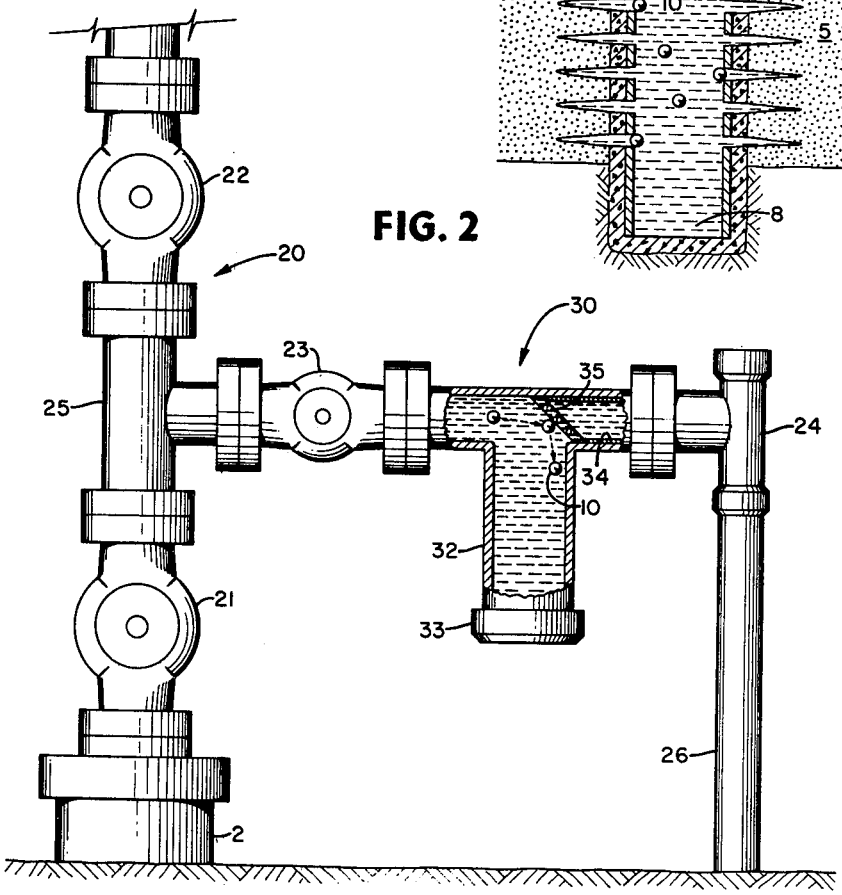
FIG. 2 is an elevation view partially in section of a typical arrangement of wellhead equipment placed on a production well to control the flow of hydrocarbons from the well including a ball catcher adapted to trap the ball sealers upstream of any equipment which they might clog or damage.

FIG. 2 shows a typical arrangement of wellhead equipment for a producing well. The well casing 2 extends slightly above the ground level and supports the wellhead 20. The production tubing 6 is contained within the casing 2 and connects with the lower end of the master valve 21. The master valve 21 controls the flow of oil and gas from the well. Above the master valve 21 is a tee 25 which provides communication with the well either through a crown valve 22 or the wing valve 23. Various workover equipment can be attached to the upper end of the crown valve 22 and communication between that equipment and the well is accomplished by opening the crown valve 22 and master valve 21. Ordinarily the crown valve 22 is maintained in a closed position. Production from the well flows from the tee 25 laterally into the wing valve 23. The wing valve 23 directs the flow of fluids from the wellhead to the gathering flowline 26.

A ball catcher 30, shown in section, is located downstream of the wing valve and upstream of the flow controlling choke 24. The produced fluid will pass through the ball catcher 30 but the ball sealers will be trapped therein. After the produced fluid passes through the choke 24 it moves into a gathering flowline 26 which will typically transport the fluid to a separation facility and then either to holding tanks or to a pipeline.

The ball catcher 30 is basically a tee having a deflector insert 34 containing a deflector grid 35 inserted into the downstream end of the tee. The deflector grid 35 allows fluid to pass through it but it will not allow objects the size of the ball sealers to proceed further downstream. Preferably the deflector grid 35 is angled within the ball catcher 30 so that when the ball sealers strike the deflector grid 35, they will be deflected into the tee's deadleg 32. A deadleg cap 33 is attached to the lower end of the deadleg 32 and can be easily removed, when the wing valve is closed and the pressure bled down, to allow the removal of the trapped ball sealers.

Other means for catching the ball sealers and preventing them from passing into well equipment is disclosed in my copending U.S. patent application Ser. No. 852,168, filed Nov. 16, 1977, the disclosure of which is incorporated herein by reference.

Experiments were conducted to test the seating efficiencies of ball sealers utilized according to present practices, i.e., ball sealers having a density greater than the treating fluid, and ball sealers utilized according to the present invention, i.e., ball sealers having a density less than the density of the treating fluid.

The laboratory experiments were designed to simulate ball sealers seating on perforations in a casing. The experimental equipment included an 8-foot long piece of 3-inch lucite tubing to represent a piece of casing. The lucite tubing was mounted vertically in the laboratory and its lower end sealed closed. Between 3 and 4 feet from the bottom of the tubing, five vertically aligned holes were drilled through the wall of the tubing to represent perforations. The holes were $\frac{3}{8}$-inch in diameter and spaced 2-inches apart on center.

A 90° elbow was placed on the upper end of the lucite tubing and was connected by a flowline to a pump. The pump drew fluid from a reservoir tank and pumped it at various controlled rates through the flowline and into the upper end of the tubing. The fluid flowed down the lucite tubing, through the perforations and returned by a flowline to the reservoir tank.

To inject the ball sealers a suitable hole was made in the elbow and a 1-inch diameter piece of tubing welded in the hole. The end of the 1-inch tubing was centered to be coaxial with the lucite tubing at the upper end of the lucite tubing. The ball sealers were introduced into the lucite tubing through the 1-inch tubing.

The flow of fluid into the upper end of the lucite tubing was measured. It was assumed that the flow through each perforation was the same and therefore the flow through each perforation was taken to be 1/5 of the measured flow into the upper end of the lucite tubing.

During the experiments, water, having a density of 1.0 grams per cubic centimeter (g/cc), was used as the fluid. Rigid ball sealers were made from four different materials having different densities. The balls were all ¾" in diameter and were made from polypropylene (0.84–0.86 g/cc density), nylon (1.11 g/cc density), acetal (1.39 g/cc density) and Teflon (2.17 g/cc density). These ball sealers did not have a protective covering.

The experiment generally involved establishing a specific flow rate of the fluid through the perforations, injecting the ball sealers through the 1-inch tubing into the upper end of the 8-foot lucite tubing and observing whether or not the ball sealers seated on the perforations. The experimental program was conducted with ball sealers made of all four materials being injected into the tubing with the water flowing through it.

A single set of tests involved injecting ten balls of the same material, one at a time, into the top of the 8-foot lucite tubing. An observation was made whether or not the ball sealer seated on one of the perforations. If a ball seated on a perforation, that ball was released from the perforation prior to dropping the next ball, so that there were always five open perforations for each ball to seat upon. During a single set of tests the fluid and its flow rate remained unchanged. After all ten balls had been dropped, the number that seated upon perforations was defined as the seating efficiency under those conditions and expressed as a percentage.

Six or seven tests were conducted to define a regression curve plotting seating efficiency against flow rate through a perforation for that particular ball sealer and fluid. These regression curves were constructed for each set of equal density ball sealers. The data from those regression curves was then used to make the graph of FIG. 3.

Figure 3:
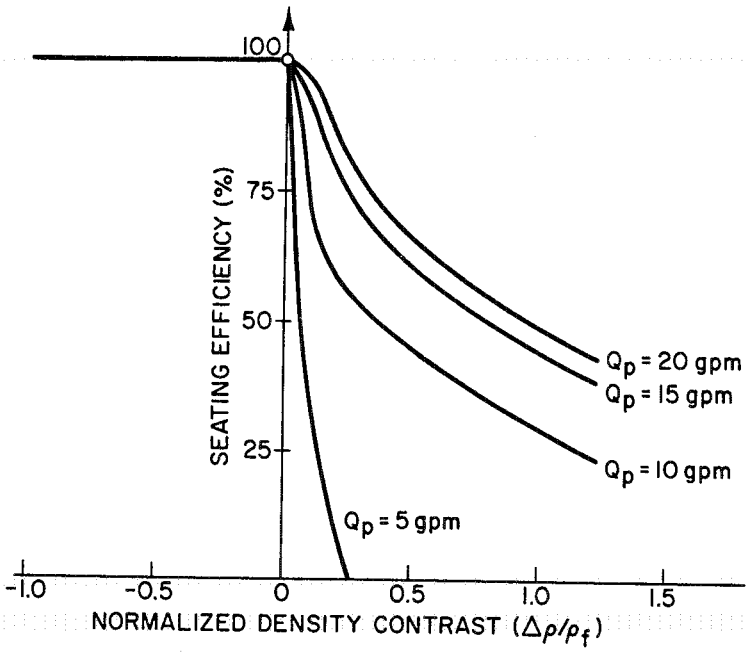
FIG. 3 is a graph of the seating efficiency versus the normalized density contrast between a ball sealer and a treating fluid based on experiments.

FIG. 3 is a plot of seating efficiency versus the normalized density contrast. The normalized density contrast is the difference in density between the ball sealer and the fluid divided by the density of the fluid. A positive normalized density contrast means the density of the ball sealer is greater than the density of the fluid and a negative normalized density contrast means the density of the ball sealer is less than the density of the fluid. It follows that a normalized density contrast of zero means that the ball sealer and the fluid have the same density.

When the normalized density contrast is greater than zero, the seating efficiency was found to be a function of the flow through the perforations. In FIG. 3 there are four plots of seating efficiency versus normalized density contrast for four different flow rates through a perforation, 20 gallons per minute (gpm), 15 gpm, 10 gpm, and 5 gpm. Also, the seating efficiency was found to increase as the normalized density contrast decreased toward zero.

When the normalized density contrast is less than zero, the seating efficiency was always observed to be 100% provided that the flow of fluid downward within the casing above the perforations is sufficient to impart a downward drag force on the ball sealers which is greater in magnitude than the upward buoyancy force acting on the ball sealers. In other words, if the downward flow of fluid within the casing is sufficient to transport the ball sealers downward to the perforations, they exhibit substantially 100% seating efficiency as demonstrated in laboratory tests.

When the normalized density contrast is greater than zero, i.e., the density of the ball sealers being greater than the density of the fluid, the seating efficiency of the ball sealers is a function of the flow rate through the perforation and the difference in density between the ball sealers and the fluid. The greater the flow rate through the perforation and the less difference in density between the ball sealers and the fluid, the greater the seating efficiency will be. The seating efficiency of ball sealers having a density greater than the density of the fluid is always a statistical phenomenon. A variation in the number, spacing and orientation of the perforations is highly likely to affect the precise seating efficiency which can be expected in that situation. Therefore, since the seating of ball sealers having a density greater than the density of the fluid is always a statistical phenomenon, there is always the possibility that too few or too many of the ball sealers will seat to get the desired diversion.

Practicing ball sealer diversion according to the present invention i.e., the use of ball sealers having a density less than the density of the fluid, will generally result in substantially 100% seating efficiency irrespective of the flow rate through the perforations and irrespective of the magnitude of difference in density between the ball sealers and the fluid. The seating efficiency of the ball sealers having a density less than the density of the fluid is only a function of the downward flow of fluid above the uppermost perforation in the casing. If the downward flow within the casing can transport the ball sealers to the level of the perforations, then the ball sealers will seat. A predictable diversion process will occur since the number of perforations plugged by the ball sealers will be equal to the lesser of the number of ball sealers injected into the casing, or the number of perforations accepting fluid.

Figure 4:
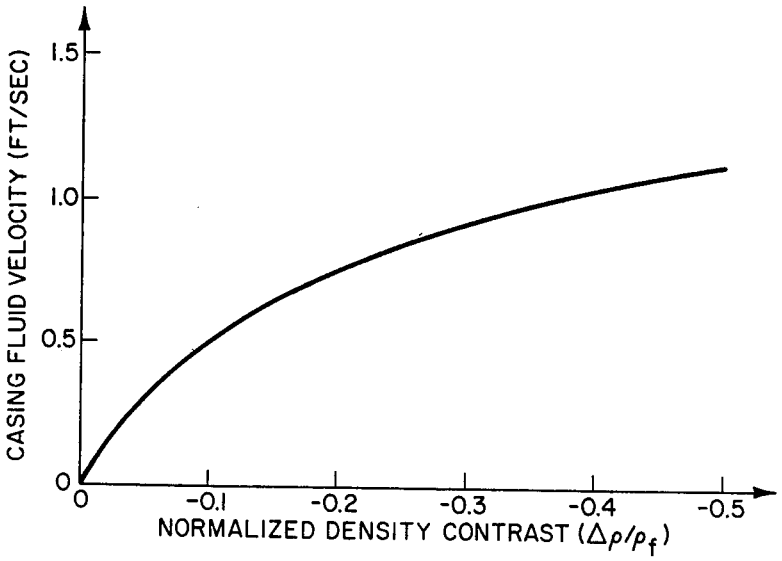
FIG. 4 is a graph of the fluid velocity within the casing versus the normalized density contrast between a ball sealer and a treating fluid based on experiments.

The relationship between the normalized density contrast and the fluid velocity needed to transport the ball sealers down the casing was investigated. FIG. 4 is a graph of the normalized density contrast between the ball sealers and the fluid plotted against the velocity of the fluid downward within the casing. This graph is based on several tests which involved placing a ball sealer within a vertical piece of lucite tubing and flowing fluid downward through the tubing. The velocity of the fluid was adjusted until the ball sealer was maintained in a fixed position at the mid-point of the tubing. In that equilibrium position the drag forces of the fluid shearing past the ball sealer were equal in magnitude to the buoyancy forces acting on the ball sealer. Ball sealers of several densities were used in conjunction with two fluids, water and 1.13 g/cc calcium chloride brine, to give the plot of FIG. 4.

The solid line defines the equilibrium condition wherein the ball sealer will remain stationary within the casing, moving neither upward nor downward. Below the line in FIG. 4 the velocity of the fluid in the casing would be insufficient to overcome the force of buoyancy and the ball sealers will rise in the casing. Above the line in FIG. 4 the velocity of the fluid in the casing exerts a drag force on the ball sealers greater in magnitude than the force of buoyancy acting on the ball sealers. Therefore, the ball sealers will be transported down the casing.

All points on the line and below it correspond to a certain normalized density contrast and a certain casing velocity which will result in a seating efficiency of zero percent. Because the ball sealers are not transported down to the perforations, they cannot seat. Whereas, if the normalized density contrast and casing velocity define a point above the line plotted in FIG. 4, the seating efficiency will generally be substantially 100%. The buoyancy of the ball sealers will maintain them at a position at or above the lowermost perforation and the downward fluid velocity in the casing above the uppermost perforation will maintain the ball sealers at or below the level of the uppermost perforation. It will take a very small fluid flow through a perforation to draw a ball sealer to the perforation and seat it thereon when the amount of time the fluid flow through the perforation has to act upon the ball sealer is limited only by the length of the injection time.

To apply the present invention in the field, it is necessary to have a ball sealer which has a density less than the wellbore fluid and at the same time has the strength to withstand the pressures encountered in the wellbore. It is not unusual for the bottom hole pressure to exceed 10,000 psi and even reach 15,000 psi during a well treatment. If a ball sealer cannot withstand these pressures, they will collapse causing the density of the ball sealer to increase to a density which can easily exceed the fluid density.

Since fluids used for treating wells generally have densities ranging from approximately 0.8 grams per cubic centimenter (g/cc) to significantly above 1.1 g/cc, a series of light weight ball sealers are required having densities in the same 0.8 to 1.1 g/cc range.

Suitable materials are currently available for use in conjunction with ball sealers in the 1.1 g/cc range and greater. In the range from 0.8 to 1.1 g/cc, techniques at manufacturing such ball sealers have not been very satisfactory. For example, there is one commercially available BUNA-N covered ball sealer having a phenolic core with considerable void volume which can have a density less than 1.0 g/cc. Since the void volume in the phenolic core is created by partially consolidating a phenolic resin using low pressure molding conditions, control of the density is extremely difficult. A representative sample was tested and proved to have an average density of 0.996 g/cc and a wide distribution (0.908 to 1.085 g/cc). Moreover, when these ball sealers were hydrostatically pressure tested, it was found that in many of the ball sealers the void volumes were unstable and had collapsed when subjected to hydrostatic pressures as low as 6,000 pounds per square inch. Correspondingly, when these void volumes collapsed, the density of the ball sealers increased.

Figure 5:
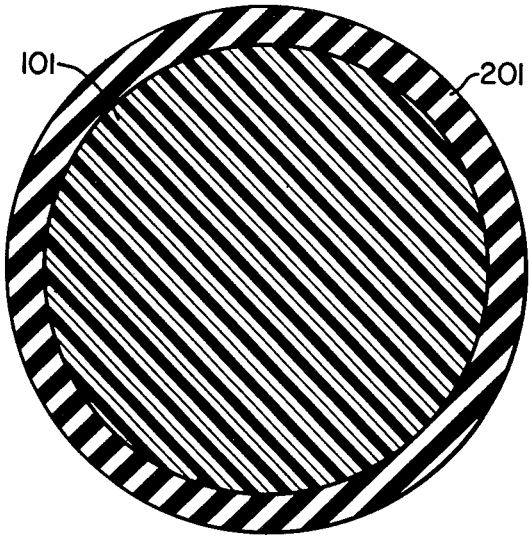
FIG. 5 is a view in section of one embodiment of a ball sealer suitable for use in the method of the present invention.

It has been found that a ball sealer comprising syntactic foam has a high compressive strength and has a density in the range from 0.8 to 1.1 g/cc. Referring to FIG. 5, there is shown a suitable syntactic foam ball sealer 101 for use in the present invention. Syntactic foam is a material system comprised of hollow spherical particles dispersed in some form of binder. The commercially available low density syntactic foams which appear to be sufficiently strong to withstand the pressures and temperatures typically encountered by ball sealers, consist of microscopically small, hollow glass spheres (averaging approximately 50 microns in diameter) dispersed in a resin binder such as epoxy. It is anticipated that in the future it may become possible in syntactic foam systems to use spheres made from materials other than glass and binders made from materials such as thermoplastics and thermosetting plastics. In fact, Emerson and Cuming Inc. has recently developed high strength glass microspheres which can withstand high pressures of the magnitude typically encountered during injection molding. If injection molding can be used to make ball sealers, it will be possible to use a lightweight thermoplastic or thermosetting plastic as the binder resulting in a high strength ball sealer having a very low density.

Several of the commercially available syntactic foams which appear to be suitable for use as the material of a low density ball sealer are listed in Table I.

TABLE I

PROPERTIES OF VARIOUS SYNTACTIC FOAM SYSTEMS

| Product | Manufacturer | Density (g/cc) | Hydrostatic Compressive Strength (psi) | Bulk Modulus (psi) |
|---|---|---|---|---|
| EL 30 | Emerson & Cuming | 0.48 | 8,000 | 250,000 |
| EL 36 | Emerson & Cuming | 0.57 | 16,000 | 390,000 |
| EL 39 | Emerson & Cuming | 0.62 | 24,000 | 420,000 |
| EF 38 | Emerson & Cuming | 0.60 | 7,000 | Not Available |
| 34-2C6 | Lockheed | 0.54 | 18,000 | Not Available |
| 36-1B4 | Lockheed | 0.57 | 13,650 | Not Available |
| 39-1B5 | Lockheed | 0.62 | 15,600 | Not Available |
| XP-241-36 | 3M | 0.57 | 11,000 | 325,000 |
| XP-241-42H | 3M | 0.67 | 20,000 | 450,000 |

The syntactic foams listed in Table I demonstrate very good compressive strength when subjected to hydrostatic pressure. Many of the materials will easily withstand 15,000 psi. Tests on a ball sealer having a syntactic foam core (Lockheed 36 1B4) and a rubber covering demonstrated that the ball sealers were capable of withstanding hydrostatic pressures up to approximately 13,500 psi before they began to fail due to the collapse of the syntactic foam. Furthermore, each of the syntactic foams for which the bulk modulus of elasticity was available has a bulk modulus of elasticity comparable to that of water, which is 300,000 psi.

The bulk modulus of elasticity is the inverse of material compressibility. It represents a material's resistance to volumetric change as a function of hydrostatic pressure. For example, if the bulk modulus of a material is greater than that of water, the material will be less compressible than water. Hence, the material's buoyancy will increase with respect to the water when both are being subjected to the same pressure since the water will be compressed more. This quality of these syntactic foams will assure that the density of the ball sealers remains less than the density of the treating fluid, thereby, avoiding the problems encountered with the phenolic core ball sealers.

Syntactic foam is currently available in blocks with a standard volume of approximately 1 cubic foot. Therefore, in order to fabricate the syntactic foam ball sealers, it is necessary to machine the syntactic foam blocks to preferably produce foam spheres having an appropriate diameter. To fabricate the syntactic foam balls, the blocks of syntactic foam material are machined in a standard manner to form syntactic foam spheres.

Syntactic foam balls may be suitably utilized in the practice of the present invention without a protective covering. However, because the syntactic foam material is fairly rigid and brittle, it is preferred that the balls be provided with a protective covering. The protective covering functions to prevent damage to the surfaces of the balls while they are being transported down the wellbore. The covering may comprise a nonelastomeric plastic material capable of plastic deformation to enable the ball sealers to conform to the perforation and form a better seal on the perforation. A suitable nonelastomeric plastic material for the practice of the present invention is a synthetic resin such as nylon or phenolic resins. The phenolic resins are commonly marketed as "Bakelite," and are manufactured by condensing phenol, cresol, or xylenol with formaldehyde using either acid or base catalysis. However, it will be obvious to one skilled in the art that other types of nonelastomeric plastic materials and nonplastic materials such as aluminum will also be suitable in the practice of the present invention.

In order to coat the ball sealers, the surface of the ball is first prepped, coated with a suitable bonding agent and then covered with the desired covering. Surface preparation involving some cleaning technique is important to assure the best possible bond between the covering and the syntactic foam. It is most desirable if surface preparation can be limited to a strong air blast which will remove most of the crushed glass and debris created during machining. Sand blasting has been used with very good success but its use should be limited to very brief treatments due to rapid abrasion of the core which leads to increased ball density as well as a highly variable batch density. If the spheres have been handled or are oily, a trichlorylethelene wash has been used satisfactorily. Once the spheres are grease and oil free, they can be dipped in a suitable bonding agent selected according to the covering material to be used.

Although syntactic foam is one ball sealer material, certain thermoplastics can also be used. Although no unfoamed plastics exhibit sufficiently low densities to make a 0.8 to 0.9 g/cc ball sealer, polymethylpentene can be used as a material for ball sealers in the 1.0 g/cc density range. Polymethylpentene has a density of 0.83 g/cc and is a high temperature thermoplastic (melting point approximately 250° C.). Ball sealers made of polymethylpentene may also be provided with a suitable protective covering. Suitable protective coverings are nonelastomeric plastic materials and nonplastic materials. All other lightweight plastics, which typically include polybutylene, polyethylene, polypropylene, and polyallomer copolymers, are nearly twice as heavy as is acceptable. Furthermore, since these materials are low temperature thermoplastics, they are probably not suitable for ball sealer materials from the standpoint that they are likely to extrude through the perforations under the bottom hole temperature and pressure conditions typically encountered.

The principle of the invention and the best mode in which it is contemplated to apply that principle have been described. It is to be understood that the foregoing is illustrative only and that other means and techniques can be employed without departing from the true scope of the invention defined in the claims.

What I claim is:

1. A method for treating a subterranean formation surrounding a casing having at least two perforations comprising:

injecting a treating fluid into the casing to cause a flow of fluid through at least one of the perforations and into the formation;

thereafter, injecting into the casing treating fluid carrying a ball sealer comprising syntactic foam, the ball sealer having a size sufficient to plug a perforation, the injection of the treating fluid into the casing being at a rate sufficient to carry the ball sealer down the casing and onto one of the perforations to substantially seal the perforation; and thereafter, injecting the treating fluid into the casing to cause a flow of fluid through the perforation which the ball sealer did not seat upon.

2. The method of claim 1 wherein said ball sealer is provided with a protective covering comprising a nonelastomeric plastic material.

3. The method of claim 2 wherein said nonelastomeric plastic material is a synthetic resin.

4. The method of claim 1 wherein said ball sealer is provided with a protective covering comprising a nonplastic material.

5. The method of claim 4 wherein said synthetic resin is selected from the group consisting of nylon and phenolic resins.

6. A method of plugging the perforations in a casing which has been set in a wellbore comprising:

downwardly flowing into said casing a carrier liquid having ball sealers suspended therein, said ball sealers comprising syntactic foam and having a density less than the density of the carrier liquid, said ball sealers being of sufficient size to plug the casing perforations; and maintaining the flow velocity of said carrier fluid at a rate sufficient to overcome the buoyancy of said ball sealers and sufficient to transport said ball sealers to the perforations.

7. The method of claim 6 wherein said ball sealer is provided with a protective covering comprising a nonelastomeric plastic material.

8. The method of claim 6 wherein said ball sealer is provided with a protective covering comprising a nonplastic material.

9. A ball sealer for plugging perforations in a casing which has been set in a wellbore comprising syntactic foam, said syntactic foam being a material system comprised of hollow spherical particles dispersed in a binder.

10. The ball sealer of claim 9 wherein said ball sealer is provided with a nonelastomeric plastic protective covering.

11. The ball sealer of claim 9 wherein said ball sealer is provided with a nonplastic protective covering.

12. A method for treating a subterranean formation surrounding a casing having at least two perforations comprising:

injecting a treating fluid into the casing to cause a flow of fluid through at least one of the perforations and into the formation;

thereafter, injecting into the casing treating fluid carrying a ball sealer comprising polymethylpentene, the ball sealer having a size sufficient to plug a perforation, the injection of the treating fluid into the casing being at a rate sufficient to carry the ball sealer down the casing and substantially sealing one of the perforations; and thereafter, injecting the treating fluid into the casing to cause a flow of fluid through the perforation which the ball sealer did not seat upon.

13. The method of claim 12 wherein said ball sealer is provided with a nonelastomeric plastic protective covering.

14. The method of claim 13 wherein said nonelastomeric plastic material is a synthetic resin.

15. The method of claim 14 wherein said synthetic resin is selected from the group consisting of nylon and phenolic resins.

16. The method of claim 12 wherein said ball sealer is provided with a nonplastic protective covering.

17. A ball sealer for plugging perforations in a casing which has been set in a wellbore comprising polymethylpentene.

18. The ball sealer of claim 17 wherein said ball sealer is provided with a nonelastomeric plastic protective covering.

19. The ball sealer of claim 17 wherein said ball sealer is provided with a nonplastic protective covering.

20. In a method of sequentially treating two strata of a subterranean formation surrounding a well casing having a plurality of perforations formed therein wherein ball sealers suspended in the treating fluid are used to seal part of said perforations, the improvement wherein said ball sealers comprise a syntactic foam core and a nonelastomeric plastic cover and have a density less than the treating fluid.

21. In a method of sequentially treating two strata of a subterranean formation surrounding a well casing having a plurality of perforations formed therein wherein ball sealers suspended in a fluid are used to seal part of said perforations, the improvement wherein said ball sealers comprise a polymethylpentene core and a nonelastomeric plastic cover and have a density less than said fluid.

* * * * *